US009108382B2

(12) United States Patent
Gnan et al.

(10) Patent No.: US 9,108,382 B2
(45) Date of Patent: Aug. 18, 2015

(54) CORRUGATED BOARD SYSTEM FOR PRODUCING CORRUGATED BOARD

(71) Applicant: BHS Corrugated Maschinen-und Anlagenbau GmbH, Weiherhammer (DE)

(72) Inventors: Alfons Gnan, Vilseck (DE); Heribert Reich, Weiherhammer (DE); Helmut Kraus, Wackersdorf (DE); Klaus Bernreuter, Caracas (VE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 28 days.

(21) Appl. No.: 13/929,009

(22) Filed: Jun. 27, 2013

(65) Prior Publication Data

US 2014/0000785 A1 Jan. 2, 2014

(30) Foreign Application Priority Data

Jun. 28, 2012 (DE) ..... 10 2012 211 118

(51) Int. Cl.
*B31F 1/20* (2006.01)
*B31F 1/28* (2006.01)
*B65H 23/188* (2006.01)

(52) U.S. Cl.
CPC ..... *B31F 1/20* (2013.01); *B31F 1/2836* (2013.01); *B65H 23/188* (2013.01); *B65H 2557/10* (2013.01)

(58) Field of Classification Search
CPC .. B65H 23/188; B65H 23/1888; B65H 23/16; B65H 2404/1521; B65H 2511/21
USPC ..... 226/34, 42, 118.2, 1, 24; 242/417, 418, 242/418.1
See application file for complete search history.

(56) References Cited

U.S. PATENT DOCUMENTS 4,704,171 A 11/1987 Thompson et al.

(Continued)

FOREIGN PATENT DOCUMENTS

| | | | |
|---|---|---|---|
| DE | 43 05 158 | A1 | 8/1994 |
| DE | 43 12 534 | A1 | 1/1995 |
| DE | 195 36 007 | A1 | 4/1997 |
| DE | 101 30 340 | A1 | 1/2003 |

(Continued)

*Primary Examiner* — Barbara J Musser
(74) *Attorney, Agent, or Firm* — McGlew and Tuttle, P.C.

(57) ABSTRACT

A corrugated board system comprises a first and a second material supply device for a first or second material web, a corrugated board production device, and a web tension measuring regulating arrangement between the corrugated board production device and the first material supply device. The arrangement comprises a web tension measuring regulating device with a web tension measuring mechanism and a first web tension regulating mechanism, and at least a second web tension regulating mechanism. The web tension measuring regulating device is arranged between the second web tension regulating mechanism and the corrugated board production device. The arrangement furthermore has an information processing unit, which receives web tension information from the web tension measuring mechanism and is configured so that to change the web tension up to a first web tension limit value, it sends web tension regulating signals to the first web tension regulating mechanism and to change the web tension beyond the first web tension limit value, it sends web tension regulating signals to the second web tension regulating mechanism.

31 Claims, 2 Drawing Sheets

(56) References Cited

U.S. PATENT DOCUMENTS

| | | | | |
|---|---|---|---|---|
| 5,632,850 | A | 5/1997 | Knorr et al. | |
| 6,749,098 | B2 | 6/2004 | Roier et al. | |
| 2002/0195515 | A1 | 12/2002 | Roier et al. | |
| 2005/0284579 | A1 | 12/2005 | Ishibuchi et al. | |
| 2006/0261119 | A1* | 11/2006 | Cummings et al. | 226/24 |

FOREIGN PATENT DOCUMENTS

| | | | |
|---|---|---|---|
| EP | 0 687 552 | A2 | 12/1995 |
| EP | 1 190 843 | A2 | 3/2002 |
| EP | 1 270 472 | A2 | 1/2003 |
| GB | 2 305 675 | A | 4/1997 |
| JP | H01 316257 | A | 12/1989 |

* cited by examiner

CORRUGATED BOARD SYSTEM FOR PRODUCING CORRUGATED BOARD

CROSS-REFERENCES TO RELATED APPLICATIONS

This application claims the priority of Patent Application, Serial No. DE 10 2012 211 118.2, filed on Jun. 28, 2012, pursuant to 35 U.S.C 119(a)-(d), the content of which is incorporated herein by reference in its entirety as if fully set forth herein.

FIELD OF THE INVENTION

Background of the Invention

Corrugated board systems or methods for producing corrugated board are generally known by public prior use. Corrugated board webs of material webs are formed in the process in the corrugated board production devices of the corrugated board systems. The drawback in the known corrugated board systems or methods for producing corrugated board is that the web tension at the intake or inlet of the corrugated board production device is generally not optimal, which often leads to problems in the corrugated board production. Furthermore, the known corrugated board systems have an extremely high energy or current requirement. The braking mechanisms used to increase the web tension are also frequently subject to a high degree of wear.

SUMMARY OF THE INVENTION

An object of the invention is therefore to provide a corrugated board system which has an improved web tension compared to conventional corrugated board systems, in particular at the inlet of the corrugated board production device. Furthermore, the corrugated board system is to have a particularly low energy or current consumption and extremely low wear of the web tension regulating mechanisms to change the web tension. A corresponding method for producing corrugated board is also to be provided.

This object is achieved according to the invention by a corrugated board system for producing corrugated board comprising a first material supply device for dispensing a first material web, at least a second material supply device for dispensing at least a second material web, a corrugated board production device for producing a corrugated board web lined on at least one side from the first material web and the at least second material web, a web tension measuring regulating arrangement, which is arranged between the corrugated board production device and the first material supply device, wherein the web tension measuring regulating arrangement comprises a web tension measuring regulating device with a web tension measuring mechanism for measuring the web tension of the first material web and a first web tension regulating mechanism for regulating the web tension of the first material web, and at least a second web tension regulating mechanism to further regulate the web tension of the first material web, the web tension measuring regulating device being arranged between the second web tension regulating mechanism and the corrugated board production device, and an information processing unit, which is connected to the web tension measuring regulating device in a data-transmitting manner, is connected to the second web tension regulating mechanism in a data-transmitting manner, receives web tension information referring to the first material web from the web tension measuring mechanism, is configured so that to change the web tension of the first material web up to a first web tension limit value, it sends web tension regulating signals to the first web tension regulating mechanism to actuate it, and is configured so that to change the web tension of the first material web beyond the first web tension limit value, it sends web tension regulating signals to the second web tension regulating mechanism to actuate it.

This object is further achieved according to the invention by a method for producing corrugated board, comprising the steps of dispensing a first material web from a first material supply device, dispensing at least a second material web from at least a second material supply device, producing a corrugated board web lined at least on one side from the first material web and the at least second material web using a corrugated board production device, providing a web tension measuring regulating arrangement, which is arranged between the corrugated board production device and the first material supply device, wherein the web tension measuring regulating arrangement measures and regulates the web tension of the first material web using a web tension measuring regulating device, which, for this purpose, comprises a web tension measuring mechanism and a first web tension regulating mechanism, and optionally further regulates the web tension of the first material web using at least a second web tension regulating mechanism, the web tension measuring regulating device being arranged between the second web tension regulating mechanism and the corrugated board production device, and providing an information processing unit, which is connected to the web tension measuring regulating device in a data-transmitting manner, is connected to the at least second web tension regulating mechanism in a data-transmitting manner, receives web tension information referring to the first material web from the web tension measuring mechanism, sends web tension regulating signals to change the web tension of the first material web up to a first web tension limit value to the first web tension regulating mechanism to actuate it, and sends web tension regulating signals to further change the web tension of the first material web beyond the first web tension limit value to the at least second web tension regulating mechanism to actuate it.

The core of the invention is that a first and at least a second web tension regulating mechanism are provided for the first material web, a change, in other words an increase or a reduction, in the web tension of the first material web firstly taking place by means of the first web tension regulating mechanism and then optionally by means of the at least second web tension regulating mechanism, which is arranged further removed than the first web tension regulating mechanism from the corrugated board production device. If necessary, therefore, the web tension regulating mechanisms are thus actuated proceeding from the corrugated board production device in the direction of the first material supply device. The web tension of the first material web is thus regulated upstream in relation to its transporting direction from the corrugated board production device. The at least second web tension regulating mechanism is arranged upstream with respect to the first web tension regulating mechanism. Fold formation can thus be extremely effectively prevented. Furthermore, the web tension regulating mechanisms are then subject to particularly low wear.

It is advantageous if, during operation, the first material web in the entire corrugated board system substantially always has a certain basic web tension. The first material web then rests on the web tension regulating mechanisms and can thus be changed particularly well and effectively with respect to its web tension. In particular, the first material web then rests on the rollers of the web tension regulating mechanisms on the outside in the peripheral direction.

The expression "an at least second web tension regulating mechanism" or the like is taken here to mean that two or more, in other words, for example, two, three, four, five etc. web tension regulating mechanisms, can be provided on the first material web. If present, the third web tension regulating mechanism is arranged upstream of the second web tension regulating mechanism. If present, the fourth web tension regulating mechanism is arranged upstream of the third web tension regulating mechanism. If present, the fifth web tension regulating mechanism is arranged upstream of the fourth web tension regulating mechanism. The same applies to any further web tension regulating mechanisms.

It is advantageous if the web tension of the second material web remains uninfluenced by the at least one web tension regulating mechanism.

The web tension of the first material web can therefore be changed in a step-wise manner. It is advantageous if each web tension regulating mechanism produces a web tension changing step here.

The first material web may be a corrugated web or a covering web.

Web tension regulating mechanisms are preferably taken to mean here mechanisms which can act directly on the material webs, preferably mechanically, in order to change their web tension. This may, for example, take place by means of the targeted actuation of rollers, around which the material webs are guided, and/or by changing the wrap angle of the material webs around the rollers.

The web tension information may, for example, be information or values, which represent direct web tensions or from which web tensions can be calculated.

The web tension regulating signals are preferably electrical signals, which are suitable to actuate the web tension regulating mechanisms.

The expression "connected in a data-transmitting-manner" is taken to mean a connection, which is capable of transmitting data or signals. A connection of this type can, for example, be formed by electric lines, optical lines, cable, radio, infrared, Bluetooth or the like.

The first web tension regulating mechanism preferably increases, in use, the web tension of the first material web up the first web tension limit value, the at least second web tension regulating mechanism then, if necessary, increasing the web tension of the first material web beyond the first web tension limit value.

The first web tension regulating mechanism, in use, preferably reduces the web tension of the first material web to the first web tension limit value, the at least second web tension regulating mechanism then, if necessary, further reducing the web tension of the first material web beyond the first web tension limit value.

The configuration in which at least one web tension regulating apparatus is provided at the first material supply device wherein the at least one web tension regulating apparatus is connected to the information processing unit to change the web tension of the first material web at the first material supply device in a data-transmitting manner allows a further adaptation of the web tension of the first material web. In particular, an adaptation of the web tension is thus possible virtually over the entire course of the first material web. The at least one web tension regulating apparatus is preferably substantially configured in accordance with the first or second web tension regulating mechanism.

An increase or reduction in the web tension of the first material web is possible in a particularly simple and effective manner owing to the configuration in which the first and/or the at least second web tension regulating mechanism comprises a braking means for increasing the web tension of the first material web and/or an acceleration means to reduce the web tension of the first material web. The braking means, in use, exerts a braking torque on the first material web, while the acceleration means, in use, exerts a corresponding acceleration torque on the first material web.

It is advantageous if the braking means and/or the acceleration means is/are formed by a roller which is in contact with the first material web and which can be decelerated and/or accelerated. The roller is preferably circular ring-shaped or circular in cross section. If the roller is decelerated, the roller acts as a braking means. On the other hand, the roller forms an accelerating means when the latter is accelerated.

The configuration in which the roller can be decelerated and/or accelerated by a drive is distinguished by its simplicity. It is advantageous if the drive is an electric drive.

A corrugated board web lined on one side or lined on multiple sides can be produced, for example by the corrugated board production device which has a fluting mechanism for fluting the first and/or the at least second material web and a connecting mechanism for the fixed flat connection of the first and the at least second material web to one another, the connecting mechanism preferably having a gluing unit and a lining unit. For this purpose, smooth material webs or covering webs are advantageously connected in a planar manner to fluted corrugated webs in the corrugated board production device. The at least one fluted or corrugated web is fluted in an undulating manner by the at least one fluting mechanism.

The connecting mechanism preferably forms a conventional lining mechanism.

The configuration according to which the connecting mechanism has gluing unit and a lining unit leads to an extremely compact and simple construction. Alternatively, it is possible for the web tension measuring mechanism and the first web tension regulating mechanism to be configured or arranged separately from one another.

The configuration in which the web tension measuring mechanism and the first web tension regulating mechanism form a unit allows the production of continuous material webs, in that first or at least second material webs are in each case connected to one another at the end. A first material web coming to an end is thus connected to a new first material web. Alternatively, the first and/or the at least second material supply device is configured as a conventional unwinding device, which in each case stores a roll of a respective material web.

The configuration in which the first web tension regulating mechanism increases the web tension of the first material web only up to the first web tension limit value and the web tension of the first material web can be increased by the second web tension regulating mechanism beyond the first web tension limit value leads to an extremely advantageous regulation of the web tension of the first material web.

The configuration in which the web tension of the first material web at the first material supply device is lower, preferably substantially lower, than at the corrugated board production device, the web tension of the first material web at the first material supply device preferably being greater than zero also produces a particularly advantageous regulation of the web tension of the first material web. The web tension of the first material web at the corrugated board production device is preferably 1.5 to 6 times, preferably 2 to 5 times, most preferably 3 to 4 times, greater than the first material supply device.

It is advantageous if the first material web in the first material supply device already has a web tension, which is greater than zero. Advantageously, the first material web thus already has a certain basic web tension in the first material supply device.

The first material web also preferably has a web tension greater than zero in the corrugated board production device. The first material web also advantageously has a web tension greater than zero between the first material supply device and the corrugated board production device. The web tension of the first material web is preferably added from the first material supply device in the direction of the corrugated board production device. Advantageously, the web tension of the first material web is added from 1.5:1 to 6:1, preferably from 2:1 to 5:1, most preferably from 3:1 to 4:1. For example, a web tension value of 50 N/m to 400 N/m can be input at the first material supply device. The first material web then has a correspondingly greater web tension at the corrugated board production device.

The configurations in which the web tension measuring regulating arrangement has at least a third web tension regulating mechanism to further regulate the web tension of the first material web, the at least third web tension regulating mechanism being connected to the information processing unit in a data-transmitting manner; in which the at least third web tension regulating mechanism is arranged upstream of the second web tension regulating mechanism on the first material web; in which the information processing unit is configured so that to change the web tension of the first material web beyond a second web tension limit value, it sends web tension regulating signals to the at least third web tension regulating mechanism to actuate it; in which upon an intentional increase of the web tension of the first material web, the second web tension limit value is greater than the first web tension limit value; and in which upon a further reduction of the web tension of the first material web, the second web tension limit value is lower than the first web tension limit value are further preferred configurations of the at least third web tension regulating mechanism.

The first web tension regulating mechanism, in use, preferably increases the web tension of the first material web up to the first web tension limit value and the second web tension regulating mechanism, in use, increases the web tension of the first material web up to a second web tension limit value, the at least third web tension regulating mechanism then, if necessary, increasing the web tension of the first material web beyond the second web tension limit value.

The first web tension regulating mechanism in use preferably reduces the web tension of the first material web up to the first web tension limit value and the second web tension regulating mechanism, in use, reduces the web tension of the first material web to the second web tension limit value, the at least third web tension regulating mechanism then, if necessary, further reducing the web tension of the first material web beyond the second web tension limit value.

The configurations in which the first web tension regulating mechanism changes the web tension of the first material web substantially up to its maximum regulating power and only then is the at least second web tension regulating mechanism optionally used to further change the web tension of the first material web; and in which the at least second web tension regulating mechanism arranged upstream of the first web tension regulating mechanism is used when a further web tension change of the first material web is impossible by means of the first web tension regulating mechanism allow a particularly advantageous regulation of the web tension of the first material web.

The first web tension regulating mechanism preferably increases, substantially to its maximum regulating power, the web tension of the first material web and only then, if necessary, is the at least second web tension regulating mechanism used to further increase the web tension of the first material web.

The first web tension regulating mechanism preferably reduces, substantially to its maximum regulating power, the web tension of the first material web and only then, if necessary, is the at least second web tension regulating mechanism used to further reduce the web tension of the first material web.

The configurations in which the web tension measuring regulating arrangement has at least a third web tension regulating mechanism to further regulate the web tension of the first material web, the at least third web tension regulating mechanism being connected to the information processing unit in a data-transmitting manner; in which the at least third web tension regulating mechanism is arranged upstream of the second web tension regulating mechanism on the first material web; in which the information processing unit is configured so that to change the web tension of the first material web beyond a second web tension limit value, it sends web tension regulating signals to the at least third web tension regulating mechanism to actuate it; in which upon an intentional increase in the web tension of the first material web, the second web tension limit value is greater than the first web tension limit value; in which upon a further reduction in the web tension of the first material web, the second web tension limit value is lower than the first web tension limit value; in which the second web tension regulating mechanism changes the web tension of the first material web substantially up to its maximum regulating power and only then is the at least third web tension regulating mechanism optionally used to further change the web tension of the first material web; in which the at least third web tension regulating mechanism arranged upstream of the second web tension regulating mechanism is used when a further web tension change of the first material web by the second web tension regulating mechanism is impossible; in which the web tension of the first material web between the first material supply device and the corrugated board production device is regulated so that the web tension of the first material web remains the same in portions and changes in a step-like manner at the at least third web tension regulating mechanism when the latter is in use; and in which the at least third web tension regulating mechanism is only actuated when the web tension of the first material web measured by the web tension measuring mechanism differs from a web tension desired value of the first material web and the second web tension regulating mechanism is adjusted to the maximum web tension change are further preferred configurations of the at least third web tension regulating mechanism.

The first and second web tension regulating mechanisms preferably increase, substantially to their respective maximum regulating power, the web tension of the first material web and only then, if necessary, is the at least third web tension regulating mechanism used to further increase the web tension of the first material web.

The first and second web tension regulating mechanisms preferably reduce, substantially to their respective maximum regulating power, the web tension of the first material web and only then, if necessary, is the at least third web tension regulating mechanism used to further reduce the web tension of the first material web.

It is advantageous if the first web tension regulating mechanism has or inputs a first web tension limit value. It is advantageous if the second web tension regulating mechanism has or inputs a second web tension limit value. The same preferably applies to any further web tension regulating mechanisms.

A combination of the subjects according to the independent claims 1 and 19 with one another and of the subjects of the sub-claims referring back thereto is possible. A combination of an independent claim with a sub-claim or with sub-claims of the other independent claim is possible.

Two preferred embodiments of the invention will be described by way of example below with reference to the accompanying drawings.

BRIEF DESCRIPTION OF THE DRAWINGS

Mutually corresponding parts or components are provided with the same reference numerals in FIGS. 1 and 2. Details of the embodiments described in more detail below may also be an invention taken individually or be part of a subject of the invention.

DESCRIPTION OF THE PREFERRED EMBODIMENTS

Figure 1:
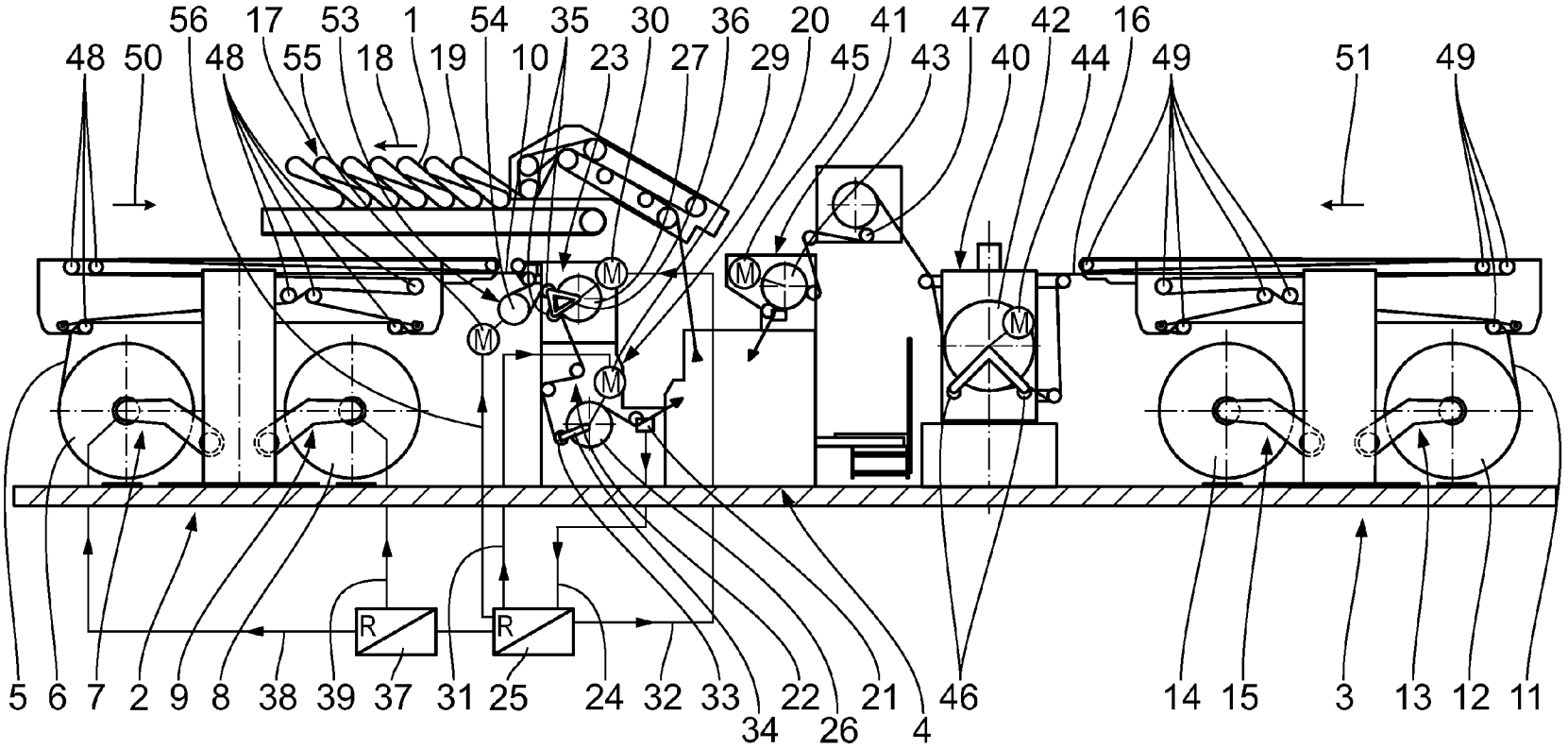
FIG. 1 shows a schematic view of a corrugated board system according to the invention according to a first embodiment.

A corrugated board system for producing a corrugated board web 1 lined one side has a first splice device 2, a second splice device 3 and a corrugated board production device 4. The first splice device 2 comprises a first unrolling unit 7 to unroll a finite first material web 5 from a first material roll 6 and a further first unrolling unit 9 to unroll a further finite first material web from a further first material roll 8. The finite first material webs 5 are connected to provide a first continuous material web 10 by means of a connecting unit, not shown, of the first splice device 2. During each connection of finite first material webs 5, a connection seam, which runs transverse to the continuous material web 10 and can optionally be separated again therefrom by means of a transverse cutting mechanism, is produced in the first continuous material web 10.

The second splice device 3 is constructed according to the first splice device 2 and comprises a second unrolling unit 13 for unrolling a finite second material web 11 from a second material roll 12 and a further second unrolling unit 15 for unrolling a further second finite material web from a further second material roll 14. The finite second material webs 11 are connected to one another to provide a second continuous material web 16 by means of a connecting unit, not shown, of the second splice device 3. At each connection of finite second material webs 11, a connecting seam, which runs transverse to the second continuous material web 16 and is optionally separated therefrom by means of a transverse cutting mechanism for quality reasons, is produced in the second continuous material web 16.

The two continuous material webs 10, 16 are fed to the corrugated board production device 4. The corrugated board production device 4 for producing a corrugated board web 1 lined on one side is generally known, for example from EP 0 687 552 A2 (corresponds to U.S. Pat. No. 5,632,850), DE 195 36 007 A1 (corresponds to GB 2 305 675 A) or DE 43 05 158 A1, to which reference is made with respect to the details. Located in the corrugated board production device 4 is a fluting device (not shown), which advantageously comprises a first fluting roller rotatably mounted about a first rotational axis and a second fluting roller rotatably mounted about a second rotational axis. The rotational axes run parallel to one another. The fluting rollers form a fluting gap. The first or second continuous material web 10, 16 can be guided through the fluting gap, whereby said web is fluted. A continuous corrugated web is then present after the fluting rollers. It is assumed here that the first continuous materials web 10 is fluted in this embodiment of the invention.

To connect the fluted first continuous material web 10 to the unfluted second continuous material web 16 to form the corrugated board web 1 lined on one side, the corrugated board production device 4 furthermore advantageously has a connecting mechanism (not shown). The connecting mechanism preferably has a gluing unit and a lining unit. It comprises a glue application roller, a glue metering roller, a glue container and two pressure rollers. To guide through and glue the fluted first continuous material web 10, the glue application roller, with the second fluting roller, forms a roller gap, the glue application roller for applying glue being partially arranged within the glue container. The glue metering roller rests against the glue application roller and is used to form a uniform glue layer on the glue application roller. To press on the first fluted continuous material web 10 provided with glue, one pressure roller, with the second fluting roller, forms a roller gap, through which the first fluted continuous material web 10 and the second unfluted continuous material web 16 are simultaneously guided. Differently configured connecting mechanisms may be alternatively used.

To temporarily store and buffer the corrugated board web 1 lined on one side, the latter is fed to a storage mechanism 17, the corrugated board web 1 lined on one side in the storage mechanism 17 having a transporting direction 18. The corrugated board web 1 in the storage mechanism 17 forms loops 19. The storage mechanism 17 is configured in a table-like manner and is also known as a bridge.

A third splice device is provided to produce a corrugated board web lined on two sides, the third web being glued to the corrugated board web 1 lined on one side in a known manner.

To regulate the web tension of the first continuous material web 10, a web tension measuring regulating arrangement is provided, which is arranged between the first splice device 2 and the corrugated board production device 4. The web tension measuring regulating arrangement comprises a web tension measuring regulating device 20, which in turn has a web tension measuring mechanism 21 to measure the web tension of the first continuous material web 10 and a first web tension regulating mechanism 22 to regulate the web tension of the first continuous material web 10. Furthermore, the web tension measuring regulating arrangement has a second web tension regulating mechanism 23 for further regulating the web tension of the first continuous material web 10. The web tension measuring regulating device 20 is arranged between the second web tension regulating mechanism 23 and the corrugated board production device 4. Furthermore, the web tension measuring mechanism 21 is arranged between the first web tension regulating mechanism 22 and the corrugated board production device 4. The second web tension regulating mechanism 23 is arranged upstream of the first web tension regulating mechanism 22.

The web tension measuring mechanism 21 measures the web tension of the first continuous material web 10 and, by means of a line 24, emits a corresponding electrical measuring signal to a central, electronic information processing unit 25. It may, for example, be configured as a measuring roller, the axis of which is transversely displaceable. This axial movement can then be detected.

The first and second web tension regulating mechanism 22 and 23 in each case comprise a main roller 26 or 27. The main rollers 26, 27 can be driven to rotate or decelerated. Electric drives 29 or 30 are associated for this with the main rollers 26, 27. The information processing unit 25 is connected or has a signal connection, in a data-transmitting manner, to the drives 29 or 30 by means of lines 31 and 32.

Furthermore, the first web tension regulating mechanism 22 has a secondary roller 33, which, with the main roller 26, forms a roller gap for the first continuous material web 10. The secondary roller 33 is pivotable in its entirety about the axis of the main roller 26. The secondary roller 33 is correspondingly mounted for this by means of a corresponding bearing arm 34.

The second web tension regulating mechanism 23, on the other hand, comprises two mutually coupled secondary rollers 35, which, with the main roller 27, form a roller gap. The secondary rollers 35 as a whole can be pivoted about the axis of the main roller 27. They are correspondingly mounted for this in a bearing frame 36.

The web tension measuring regulating arrangement also comprises a third web tension regulating mechanism 53 for further regulating the web tension of the first continuous material web 10. The third web tension regulating mechanism 53 is arranged upstream of the second web tension regulating mechanism 23 on the first material web 5, 10. It is thus located between the second web tension regulating mechanism 23 and the first splice device 2.

The third web tension regulating mechanism 53 comprises a main roller 54, which can be driven to rotate or can be decelerated. An electric drive 55 is associated for this with the main roller 54 for actuation. The first continuous material web 10 rests on the main roller 54 in regions on the periphery.

The information processing unit 25 is connected or has a signal connection to the drive 55, in a data transmitting manner, by means of a line 56. The drive 55 receives corresponding web tension information with respect to the first material web 5, 10 from the information processing unit 25.

The information processing unit 25 is furthermore connected, in a data-transmitting manner, to the first material roll 6 and the further first material roll 8 in order to also regulate the web tension of the first material web 5 there, as well. The information processing unit 25 is connected for this, in a data-transmitting manner, to a further electronic information processing unit 37. The further information processing unit 37 is connected, in a data-transmitting manner, by lines 38 or 39 to the first material roll 6 or the further first material roll 8. Observed more closely, the lines 38 and 39 are in each case connected to a web tension regulating apparatus (not shown) in a data-transmitting manner, said apparatus being associated with the first material roll 6 or the further first material roll 8. The information processing units 25 and 37 may be combined to form a common unit.

A first or a second web tension regulator 40, 41 for regulating the web tension of the second continuous material web 16 are arranged between the second splice device 3 and the corrugated board production device 4. The first and second web tension regulators 40, 41 again have a main roller 42 or 43, which can be accelerated and/or decelerated by a drive 44 or 45. Secondary rollers 46 or 47 are associated with the main rollers 42, 43 and can as a whole be pivoted about the axis of the respective main roller 42 or 43 and in each case form therewith a roller gap for the second continuous material web 16. The drives 44 or 45 are preferably not connected in a data-transmitting manner to the information processing units 25 or 37. A connection of this type is, however, alternatively possible.

The function or the operation of the corrugated board system will be described below. The first material web 5 is unrolled from the first material roll 6. The first material web 5 or the first continuous material web 10 is then guided by means of deflection rollers 48 to the third web tension regulating mechanism 53, where it runs in regions around the main roller 54. From the third web tension regulating mechanism 53, the first material web 5 or the first continuous material web 10 is then guided to the second web tension regulating mechanism 23, where it runs through the roller gap between the secondary rollers 35 and the main roller 27. The first material web 5 or the first continuous material web 10 then runs after the second web tension regulating mechanism 23 into the first web tension regulating mechanism 22, where it runs through the roller gap between the secondary roller 33 and the main roller 26. The first material web 5 or the first continuous material web 10 then runs into the corrugated board production device 4 by means of its inlet.

The third web tension regulating mechanism 53 is thus arranged downstream of the first splice device 2, the third web tension regulating mechanism 53 in turn being arranged upstream of the first web tension regulating mechanism 22 and upstream of the second web tension regulating mechanism 23.

The second web tension regulating mechanism 23 is thus arranged downstream of the first splice device 2, the first web tension regulating mechanism 22 in turn being arranged downstream of the second web tension regulating mechanism 23. The corrugated board production device 4 is in turn arranged downstream of the first web tension regulating mechanism 22.

The second material web 11 is unrolled from the second material roll 12. The second material web 11 or the second continuous material web 16 is guided by means of deflection rollers 49 to the first web tension regulator 40, where it runs through the roller gap formed between the secondary rollers 46 and the main roller 42. The second material web 11 or the second continuous material web 16 is then guided into the second web tension regulator 41, in which it runs through the roller gap formed by the secondary roller 47 and the main roller 43. The second material web 11 or the second continuous material web 16 then arrives in the corrugated board production device 4 by means of its inlet.

The first material web 5 or the first continuous material web 10 is conveyed in a transporting direction 50 from the first splice device 2, while the second material web 11 or the second continuous material web 16 is transported from the second splice device 3 in a transporting direction 51.

As already mentioned, the corrugated web is formed in that the first material web 5 or the first continuous material web 10 is guided through the fluting gap present between the fluting rollers. The corrugated web is then guided through the roller gap, which is formed between the second fluting roller and the glue application roller. The corrugated web provided with glue and the second material web 11 or the second continuous material web 16 are then guided through the roller gap, which is present between the two pressure rollers. The second material web 11 being used as a covering web or second continuous material web 16 is thus glued to the fluted corrugated web 5, 10.

The corrugated board web 1 produced lined on one side is then fed for temporary storage and buffering from the outlet of the corrugated board production device 4 to the storage mechanism 17, where the corrugated board web 1 is transported along the transporting direction 18.

The information processing unit 25 regulates the corrugated board system. In this case, the information processing unit 25 receives electrical web tension information or measuring signals from the web tension measuring mechanism 21 by means of the line 24. The measured web tension information is processed in the information processing unit 25. The information is provided to the information processing unit 25 in such a way that the information processing unit 25 knows when the web tension of the first material web 5 or the first continuous material web 10 at the web tension measuring mechanism 21 changes, in other words increases or reduces. Depending on the web tension determined by the web tension measuring mechanism 21, the first drive 29 of the first web tension regulating mechanism 22 is activated.

If the web tension value of the first material web 5 or the first continuous material web 10 measured by the web tension measuring mechanism 21 is different than a web tension desired value, the drive 29 is actuated by means of the line 31 by the information processing unit 25. If the web tension value of the first material web 5 or the first continuous material web 10 measured by the web tension measuring mechanism 21 is lower than the web tension desired value, the braking torque of the main roller 26 is increased or the drive torque of the main roller 26 is reduced by the drive 29, which brings about an increase in the web tension actual value of the first material web 5 or the first continuous material web 10. The web tension is, in this case, changed up to a predetermined first web tension limit value by the drive 29.

If the web tension actual value measured by the web tension measuring mechanism 21 is greater than the web tension desired value, the braking torque of the main roller 26 is reduced or the drive torque of the main roller 26 is increased by the drive 29, which about a corresponding reduction in the web tension actual value.

If a change in the web tension over the first web tension limit value is necessary, the information processing unit 25 actuates the second drive 30 by means of the line 32. The torque of the main roller 26 applied by the drive 29 is reinforced by the drive 30. If the drive 29 thus brings about, by means of the main roller 26, a braking torque on the first material web 5 or the first continuous material web 10, the drive 30 also applies a braking torque by means of the main roller 27 on the first material web 5 or the first continuous material web 10. Conversely, it also applies that the drive 30, by means of the main roller 26, applies a drive torque to the first material web 5 or the first continuous material web 10 when the drive 29, by means of the main roller 27, applies a drive torque to the first material web 5 or the first continuous material web 10. The drive 29 delivers a maximum torque at the first web tension limit value. The wrap angles about the main rollers 26, 27 can remain constant during the change in the web tension.

The web tension of the first material web 5 is adjusted here in such a way that at the first splice device 2 or at the currently active material roll 6, 8, it is smaller, preferably substantially smaller, than at the inlet of the corrugated board production device 4.

Furthermore, the second web tension regulating mechanism 23 is actuated in such a way that the web tension desired value at the first splice device 2 is at a minimum, but greater than zero.

The second web tension regulating mechanism 23 is actuated to further reduce the web tension of the first material web 5, 10, when the web tension of the first material web 5, 10 measured by the web tension measuring mechanism 21 is greater than a web tension desired value of the first material web 5, 10 and the first tension regulating mechanism 22 is already adjusted to a maximum web tension reduction.

The second web tension regulating mechanism 23 is actuated to further increase the web tension of the first material web 5, 10 when the web tension of the first material web 5, 10 measured by the web tension measuring mechanism 21 is lower than a web tension desired value of the first material web 5, 10 and the first web tension regulating mechanism 22 is already adjusted to a maximum web tension increase.

The method outlined above for controlling the web tension basically takes place such that the web tension at the first splice device 2 or material supply mechanism is as low as possible. The web tension of the first material webs 5, 10, which run into the corrugated board production device 4, is adjusted upstream of the corrugated board production device 4. At the respective first material web 5, 10, the web tension regulating mechanism 22, which is arranged directly upstream of the corrugated board production device 4, is firstly put into action. If, for example, the braking torque applied by this web tension regulating mechanism 22 is not sufficient, the web tension regulating mechanism 23, 53 located behind it upstream, in each case, is additionally activated to increase the web tension.

If a change in the web tension over the second web tension limit value is required, the information processing unit 25 actuates the third drive 55 by means of the line 56. The torque applied by the main rollers 26, 27 is reinforced by the drive 55. Thus, if the drive 29, by means of the main roller 26, and the drive 30, by means of the main roller 27, each apply a braking torque to the first material web 5 or the first continuous material web 10, the drive 55 also applies a corresponding braking torque by means of the main roller 54.

Conversely, it also applies that, if necessary, the drive 55 applies a drive torque to the first material web 5 or the first continuous material web 10 by means of the main roller 54 when the drive 29, by means of the main roller 27, and the drive 30, by means of the main roller 26, respectively apply a drive torque to the first material web 5 or the first continuous material web 10.

The drives 29, 30, at the second web tension limit value, deliver a maximum torque, from which the drive 55 is active.

Furthermore, the third web tension regulating mechanism 53 is also actuated in such a way that the web tension desired value at the first splice device 2 is at a minimum, but greater than zero.

The third web tension regulating mechanism 53 is actuated to further reduce the web tension of the first material web 5, 10 when the web tension of the first material web 5, 10 measured by the web tension measuring mechanism 21 is greater than a web tension desired value of the first material web 5, 10 and the first and second web tension regulating mechanism 22, 23 are already adjusted to a maximum web tension reduction.

The third web tension regulating mechanism 53 is actuated to further increase the web tension of the first material web 5, 10 when the web tension of the first material web 5, 10 measured by the web tension measuring mechanism 21 is smaller than a web tension desired value of the first material web 5, 10 and the first and second web tension regulating mechanism 22, 23 are already adjusted to a maximum web tension limit increase.

If the braking torque applied by the second web tension regulating mechanism 23 is not sufficient, for example, the third web tension regulating mechanism 53 located behind it upstream in each case is additionally activated for a web tension increase.

The web tension produced at the first splice device 2 can thus be as low as possible, lower than the desired value at the corrugated board production device 4, which is generally three to four times the web tension at the splice device 2. The lower web tension at the splice device 2 has the advantage that the fold formation in the splice device 2 is thereby minimised. As already mentioned, the web tension produced at the first splice device 2 is as small as possible, but greater than zero.

Figure 2:
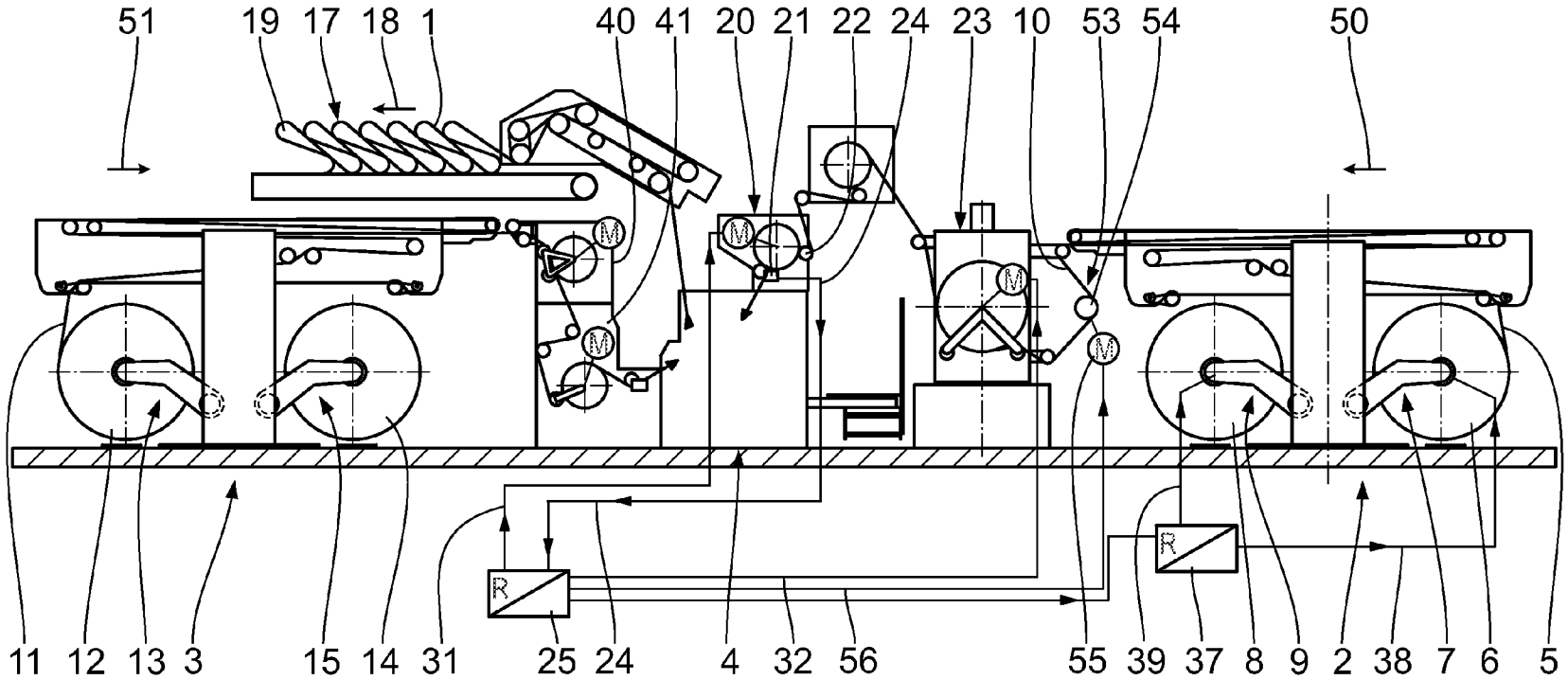
FIG. 2 shows a schematic view of a corrugated board system according to the invention according to a second embodiment.

With reference to FIG. 2, the second embodiment of the invention will be described below. Identical components have the same reference numerals as in the previous embodiment, to which reference is hereby made. In contrast to the first embodiment, in the embodiment according to FIG. 2, the second material web 11 or the second continuous material web 16 is fluted. The first material webs 5, 10 are unfluted covering webs here and are regulated again. Proceeding from the corrugated board production device 4, the web tension measuring regulating device 20 with the web tension measuring mechanism 21 and the first web tension regulating mechanism 22, the second web tension regulating mechanism 23 and the third web tension regulating mechanism 53 are arranged here in the upstream direction on the first material web 5. Arranged upstream of the third web tension regulating mechanism 53 is the first material supply device 2, from which the first material web 5 is dispensed. If necessary, the web tension regulating mechanisms 22, 23, 53 are actuated again proceeding from the corrugated board production device 4 in the direction of the first material supply device 2.

According to an alternative embodiment, the second web tension regulating mechanism 23 and the third web tension regulating mechanism 53 are arranged interchanged with one another. The second web tension regulating mechanism 23 then forms the third web tension regulating mechanism, while the third web tension regulating mechanism 53 forms the second web tension regulating mechanism.

In a further preferred embodiment, the web tension of the first and second material web 5, 11 or the first and second continuous web 10, 16 is changed. Proceeding from the corrugated board device 4, in the upstream direction, arranged here both on the first material web 5 and on the second material web 11 are, in each case, the web tension measuring regulating device 20 with the web tension measuring mechanism 21 and the first web tension regulating mechanism 22, the second web tension regulating mechanism 23 and the third web tension regulating mechanism 53. Arranged upstream of the one third web tension regulating mechanism 53 is the first material supply device 2, from which the first material web 5 is dispensed. Arranged upstream of the other third web tension regulating mechanism 53 is the second material supply device 3, from which the second material web 11 is dispensed. If necessary, the web tension regulating mechanisms 22, 23, 53 are actuated again proceeding from the corrugated board production device 4 in the direction of the first material supply device 2 or the second material supply device 3.

What is claimed is:

1. A corrugated board system for producing corrugated board, the corrugated board system comprising:

a first material supply device for dispensing a first material web;

at least a second material supply device for dispensing at least a second material web;

a corrugated board production device for producing a corrugated board web lined on at least one side from the first material web and the at least second material web;

a web tension measuring regulating arrangement, which is arranged between the corrugated board production device and the first material supply device, wherein the web tension measuring regulating arrangement comprises a web tension measuring regulating device with a web tension measuring mechanism for measuring the web tension of the first material web and a first web tension regulating mechanism for regulating the web tension of the first material web, said web tension measuring regulating arrangement further comprising at a second web tension regulating mechanism to further regulate the web tension of the first material web, the web tension measuring regulating device being arranged between the second web tension regulating mechanism and the corrugated board production device, said web tension measuring regulating arrangement further comprising at least a third web tension regulating mechanism to further regulate the web tension of the first material web, wherein the at least third web tension regulating mechanism is arranged upstream of the second web tension regulating mechanism on the first material web, said web tension measuring regulating arrangement further comprising an information processing unit, which is connected to the web tension measuring regulating device in a data-transmitting manner, said information processing unit being connected to the second web tension regulating mechanism in a data-transmitting manner, said information processing unit being connected to the at least third web tension regulating mechanism in a data-transmitting manner, said information processing unit receiving web tension information referring to the first material web from the web tension measuring mechanism, said information processing unit being configured so that to change the web tension of the first material web up to a first web tension limit value, said information processing unit sends web tension regulating signals to the first web tension regulating mechanism to actuate the first web tension regulating mechanism, said information processing unit being configured so that to change the web tension of the first material web beyond the first web tension limit value, said information processing unit sends web tension regulating signals to the second web tension regulating mechanism to actuate the second web tension regulating mechanism, said information processing unit being configured so that to change the web tension of the first material web beyond a second web tension limit, said information processing unit sends web tension regulating signals to the at least third web tension regulating mechanism to actuate the third web tension regulating mechanism.

2. A corrugated board system according to claim 1, wherein at least one web tension regulating apparatus is provided at the first material supply device, wherein the at least one web tension regulating apparatus is connected to the information processing unit to change the web tension of the first material web at the first material supply device in a data-transmitting manner.

3. A corrugated board system according to claim 1, wherein at least one of the first web tension regulating mechanism and the second web tension regulating mechanism, comprises at least one of a braking means for increasing the web tension of the first material web and an acceleration means to reduce the web tension of the first material web.

4. A corrugated board system according to claim 3, wherein at least one of the braking means and the acceleration means is formed by a roller, which is in contact with the first material web and can be decelerated, accelerated as well as simultaneously be decelerated, and accelerated.

5. A corrugated board system according to claim 4, wherein the roller can be decelerated, accelerated as well as simultaneously be decelerated, and accelerated by a drive.

6. A corrugated board system according to claim 1, wherein the corrugated board production device has a fluting mechanism for fluting at least one of the first and the at least second material web and a connecting mechanism for the fixed flat connection of the first and the at least second material web to one another.

7. A corrugated board system according to claim 6, wherein the connecting mechanism has a gluing unit and a lining unit.

8. A corrugated board system according to claim 1, wherein the web tension measuring mechanism and the first web tension regulating mechanism form a unit.

9. A corrugated board system according to claim 1, wherein one or more of the first material supply device and the at least second material supply device is configured as a splice device.

10. A corrugated board system according to claim 1, wherein the first web tension regulating mechanism increases the web tension of the first material web only up to the first web tension limit value and the web tension of the first material web can be increased by the second web tension regulating mechanism beyond the first web tension limit value.

11. A corrugated board system according to claim 1, wherein the web tension of the first material web at the first material supply device is lower than at the corrugated board production device.

12. A corrugated board system according to claim 11, wherein the web tension of the first material web at the first material supply device is substantially lower than at the corrugated board production device.

13. A corrugated board system according to claim 11, wherein the web tension of the first material web at the first material supply device is greater than zero.

14. A corrugated board system according to claim 1, wherein upon an intentional increase of the web tension of the first material web, the second web tension limit value is greater than the first web tension limit value.

15. A corrugated board system according to claim 1, wherein upon a further reduction of the web tension of the first material web, the second web tension limit value is lower than the first web tension limit value.

16. A method for producing corrugated board, the method comprising the steps:

dispensing a first material web from a first material supply device;

dispensing at least a second material web from at least a second material supply device;

producing a corrugated board web lined at least on one side from the first material web and the at least second material web using a corrugated board production device;

providing a web tension measuring regulating arrangement, which is arranged between the corrugated board production device and the first material supply device, wherein the web tension measuring regulating arrangement measures and regulates the web tension of the first material web using a web tension measuring regulating device, which, comprises a web tension measuring mechanism and a first web tension regulating mechanism, and the web tension measuring regulating arrangement optionally further regulates the web tension of the first material web using a second web tension regulating mechanism, the web tension measuring regulating device being arranged between the second web tension regulating mechanism and the corrugated board production device, the web tension measuring regulating arrangement having at least a third web tension regulating mechanism to further regulate the web tension of the first material web, wherein the at least third web tension regulating mechanism is arranged upstream of the second web tension regulating mechanism on the first material web; and providing an information processing unit, which is connected to the web tension measuring regulating device in a data-transmitting manner, the information processing unit being connected to the second web tension regulating mechanism in a data-transmitting manner, the information processing unit being connected to the at least third web tension regulating mechanism in a data-transmitting manner, the information processing unit receiving web tension information referring to the first material web from the web tension measuring mechanism, the information processing unit sending web tension regulating signals to change the web tension of the first material web up to a first web tension limit value to the first web tension regulating mechanism to actuate the first web tension regulating mechanism, the information processing unit sending web tension regulating signals to further change the web tension of the first material web beyond the first web tension limit value to the second web tension regulating mechanism to actuate the second web tension regulating mechanism, the information processing unit being configured so that to change the web tension of the first material web beyond a second web tension limit value, the information processing unit sends web tension regulating signals to the at least third web tension regulating mechanism to actuate the third web tension regulating mechanism.

17. A method according to claim 16, wherein the first web tension regulating mechanism changes the web tension of the first material web substantially up to its maximum regulating power and only then is the at least second web tension regulating mechanism optionally used to further change the web tension of the first material web.

18. A method according to claim 16, wherein the second web tension regulating mechanism arranged upstream of the first web tension regulating mechanism is used when a further web tension change of the first material web is impossible by means of the first web tension regulating mechanism.

19. A method according to claim 16, wherein the web tension of the first material web is regulated so that when a desired web tension is input at the inlet of the corrugated board production device, the web tension at the outlet of the first material supply device is minimal, but greater than zero.

20. A method according to claim 16, wherein the web tension of the first material web between the first material supply device and the corrugated board production device is regulated so that the web tension of the first material web remains the same in portions and changes in a step-like manner at the first web tension regulating mechanism, when the first web tension regulating mechanism is in use.

21. A method according to claim 16, wherein the web tension of the first material web between the first material supply device and the corrugated board production device is regulated so that the web tension of the first material web remains the same in portions and changes in a step-like manner at the second web tension regulating mechanism, when the second web tension regulating mechanism is in use.

22. A method according to claim 16, wherein the first web tension regulating mechanism increases the web tension of the first material web when the web tension of the first material web measured by the web tension measuring mechanism is lower than a web tension desired value of the first material web.

23. A method according to claim 16, wherein the first web tension regulating mechanism reduces the web tension of the first material web, when the web tension of the first material web measured by the web tension measuring mechanism is greater than a web tension desired value of the first material web.

24. A method according to claim 16, wherein the at least second web tension regulating mechanism is only actuated when the web tension of the first material web measured by the web tension measuring mechanism differs from a web tension desired value of the first material web and the first web tension regulating mechanism is adjusted to maximum web tension change.

25. A method according to claim 16, wherein upon an intentional increase in the web tension of the first material web, the second web tension limit value is greater than the first web tension limit value.

26. A method according to claim 16, wherein upon a further reduction in the web tension of the first material web, the second web tension limit value is lower than the first web tension limit value.

27. A method according to claim 16, wherein the second web tension regulating mechanism changes the web tension of the first material web substantially up to its maximum regulating power and only then is the at least third web tension regulating mechanism optionally used to further change the web tension of the first material web.

28. A method according to claim 16, wherein the at least third web tension regulating mechanism arranged upstream of the second web tension regulating mechanism is used when a further web tension change of the first material web by the second web tension regulating mechanism is impossible.

29. A method according to claim 16, wherein the web tension of the first material web between the first material supply device and the corrugated board production device is regulated so that the web tension of the first material web remains the same in portions and changes in a step-like manner at the at least third web tension regulating mechanism when the at least third web tension regulating mechanism is in use.

30. A method according to claim 16, wherein the at least third web tension regulating mechanism is only actuated when the web tension of the first material web measured by the web tension measuring mechanism differs from a web tension desired value of the first material web and the second web tension regulating mechanism is adjusted to the maximum web tension change.

31. A corrugated board system for producing corrugated board, the corrugated board system comprising:

a first material supply device for dispensing a first material web;

a second material supply device for dispensing at least a second material web;

a corrugated board production device for producing a corrugated board web lined on at least one side from the first material web and the at least second material web;

a web tension measuring regulating arrangement arranged between the corrugated board production device and the first material supply device, the web tension measuring regulating arrangement comprising a web tension measuring regulating device, the web tension measuring regulating device comprising a web tension measuring mechanism for measuring the web tension of the first material web and the web tension measuring regulating device comprising a first web tension regulating mechanism, a second web tension regulating mechanism and a third web tension regulating mechanism for regulating the web tension of the first material web, said web tension regulating mechanism being arranged between the second web tension regulating mechanism and the corrugated board production device, the third web tension regulating mechanism being arranged upstream of the second web tension regulating mechanism with respect to a traveling direction of the first material web, said web tension measuring regulating arrangement further comprising an information processing unit, said information processing unit being operatively connected to the web tension measuring regulating device, the second web tension regulating mechanism and the third web tension regulating mechanism, said information processing unit receiving web tension data corresponding to the first material web from the web tension measuring mechanism, said information processing unit providing web tension regulating signals to the first web tension regulating mechanism as input to actuate the first web tension regulating mechanism to change the web tension of the first material web up to a first web tension limit value, said information processing unit providing web tension controlling signals to the second web tension regulating mechanism as input to actuate the second web tension regulating mechanism to change the web tension of the first material web beyond the first web tension limit value, said information processing unit providing web tension controlling signals to the at least third web tension regulating mechanism as input to actuate the third web tension regulating mechanism to change the web tension of the first material web beyond a second web tension limit.

* * * * *